US009217400B2

(12) United States Patent
Koike et al.

(10) Patent No.: US 9,217,400 B2
(45) Date of Patent: Dec. 22, 2015

(54) INTAKE APPARATUS

(75) Inventors: Michiko Koike, Hamamatsu (JP); Takayuki Ichikawa, Hamamatsu (JP)

(73) Assignee: ROKI CO., LTD., Shizuoka (JP)

( * ) Notice: Subject to any disclaimer, the term of this patent is extended or adjusted under 35 U.S.C. 154(b) by 18 days.

(21) Appl. No.: 14/114,115

(22) PCT Filed: Apr. 24, 2012

(86) PCT No.: PCT/JP2012/060950

§ 371 (c)(1),
(2), (4) Date: Nov. 4, 2013

(87) PCT Pub. No.: WO2012/147729

PCT Pub. Date: Nov. 1, 2012

(65) Prior Publication Data

US 2014/0048032 A1 Feb. 20, 2014

(30) Foreign Application Priority Data

Apr. 26, 2011 (JP) ..... P 2011-098747

(51) Int. Cl.

| | |
|---|---|
| ***F02M 35/00*** | (2006.01) |
| ***F02M 35/04*** | (2006.01) |
| ***F02M 35/02*** | (2006.01) |
| ***F02M 35/024*** | (2006.01) |
| ***F02M 35/10*** | (2006.01) |

(52) U.S. Cl.

CPC ..... *F02M 35/044* (2013.01); *F02M 35/0204* (2013.01); *F02M 35/0245* (2013.01); *F02M 35/02416* (2013.01); *F02M 35/02491* (2013.01); *F02M 35/048* (2013.01); *F02M 35/10144* (2013.01); *F02M 35/10354* (2013.01)

(58) Field of Classification Search

CPC ..... F02M 35/044; F02M 35/0204; F02M 35/0245; F02M 35/02491; F02M 35/048; F02M 35/10354; F02M 35/02416; F02M 35/10144

USPC ..... 180/68.3; 55/385.3, 476, 480

See application file for complete search history.

(56) References Cited

U.S. PATENT DOCUMENTS 4,778,029 A * 10/1988 Thornburgh ..... 181/229
5,929,397 A * 7/1999 Satoh et al. ..... 181/229

(Continued)

FOREIGN PATENT DOCUMENTS

DE 202008005603 U1 9/2009
JP 63-28865 U 2/1988

(Continued)

OTHER PUBLICATIONS

International Search Report of PCT/JP2012/060950, dated Jun. 5, 2012.

*Primary Examiner* — Marguerite McMahon
(74) *Attorney, Agent, or Firm* — Sughrue Mion, PLLC

(57) ABSTRACT

An intake apparatus that mounts an air cleaner and an outdoor air duct inside an engine room and ensures space for maintenance that includes: a bottomed tubular case having an opened end and formed with an inflow port; a cover formed with an outflow port and configured to close the opened end of the case; an air cleaner disposed between the case and the cover and provided with a filter member dividing an interior of the air cleaner into a clean side positioned on the inflow port side and a dust side positioned on the outflow port side; and an outdoor air duct configured to introduce outdoor air into the air cleaner.

4 Claims, 6 Drawing Sheets

(56) References Cited

U.S. PATENT DOCUMENTS

| | | | | |
|---|---|---|---|---|
| 8,486,173 | B2 * | 7/2013 | Fikany et al. | 55/385.3 |
| 2003/0075923 | A1 | 4/2003 | Lepoutre | |
| 2006/0006011 | A1 * | 1/2006 | Khouw et al. | 180/68.3 |
| 2007/0068589 | A1 | 3/2007 | Kino et al. | |
| 2009/0165740 | A1 | 7/2009 | Kubo | |
| 2011/0023427 | A1 | 2/2011 | Srinivasan et al. | |
| 2013/0139483 | A1 * | 6/2013 | Jung | 55/480 |
| 2013/0192912 | A1 * | 8/2013 | Shimomura et al. | 180/68.3 |

FOREIGN PATENT DOCUMENTS

| | | | |
|---|---|---|---|
| JP | 2006-291846 | A | 10/2006 |
| JP | 2007-85315 | A | 4/2007 |
| JP | 2008-88843 | A | 4/2008 |
| JP | 2009-162080 | A | 7/2009 |
| JP | 2009-190444 | A | 8/2009 |
| JP | 2010-71173 | A | 4/2010 |
| JP | 2010-196504 | A | 9/2010 |

* cited by examiner

INTAKE APPARATUS

CROSS REFERENCE TO RELATED APPLICATIONS

This application is a National Stage of International Application No. PCT/JP2012/060950 filed Apr. 24, 2012, claiming priority based on Japanese Patent Application No. 2011-098747, filed Apr. 26, 2011, the contents of all of which are incorporated herein by reference in their entirety.

TECHNICAL FIELD

The present invention relates to an intake apparatus of an internal combustion engine provided with an air cleaner for cleaning outdoor air introduced into an internal combustion engine of an automobile or like and an outdoor air duct connected to the air cleaner to thereby introduce the outdoor air into the internal combustion engine.

Conventionally, there are known various types of intake apparatus or systems each provided with an air cleaner for cleaning outdoor air introduced into an internal combustion engine and an outdoor air duct connected to the air cleaner to thereby introduce the outdoor air.

There is also known various structures related to connection method for connecting the air cleaner and the outdoor air duct in consideration of performance for reducing ventilation resistance and assembling such intake apparatus to a vehicle body.

PRIOR ART DOCUMENT

Patent Document

Patent Document 1: Japanese Patent Laid-open Publication No. 2010-196504

Patent Document 2: Japanese Patent Laid-open Publication No.

An intake apparatus disclosed in the Patent Document 1 has an fitting structure of an outdoor air duct and an air cleaner, in which a fitting portion of the outdoor air duct and a fitting portion of the air cleaner are arranged in a manner such that the fitting portion of the outdoor air duct is positioned inside the fitting portion of the air cleaner, and the fitting portion is inclined obliquely with respect to a perpendicular direction.

As described above, the intake apparatus of the Patent Document 1 makes it possible to make smooth an intake air flow path form the outdoor air duct, thus reducing ventilation resistance.

On the other hand, the intake apparatus disclosed in the Patent Document 2 is provided with an outdoor air-introduction duct disposed at a front end of a vehicle body for introducing the outdoor air, and an air cleaner box is connected to a rear side of the outdoor air-introduction duct. In such intake apparatus, the outdoor air-introduction duct and the air cleaner box are connected to each other by vertically fitting the connecting portions thereof, thus constituting a vertically fitting structure.

As described above, in the intake apparatus of the Patent Document 2, it becomes possible to arrange vehicle components at a position in the vicinity of a rear portion of the air cleaner box, thereby improving freedom in design.

SUMMARY OF THE INVENTION

Problems to be Solved by the Invention

However, in an intake apparatus incorporated in an internal combustion engine, a filter member accommodated in the interior of an air cleaner is spoiled in accordance with repeated operation of the internal combustion engine, and cleaning function thereof is deteriorated due to, for example, piling of dust or like. Accordingly, periodical maintenance such as cleaning or exchange of the filter member is required, and after installation or mounting to a vehicle, it becomes necessary for the filter member to perform the maintenance working by disassembling the air cleaner or like. Moreover, since various devices or components are mounted for performing the operation of the internal combustion engine, it becomes very difficult to ensure a space for the maintenance inside an engine room in which the internal combustion engine is disposed, thus providing a problem.

The present invention was therefore conceived in consideration of the circumstances mentioned above, and an object of the present invention is to provide an intake apparatus capable of easily mounting or installing an air cleaner and an outdoor air duct in an engine room of an internal combustion engine to which various devices or components are mounted and also capable of ensuring a sufficient maintenance space in the engine room.

Means for Solving the Problem

An intake apparatus according to the present invention includes: a bottomed tubular case having an opened end and formed with an inflow port; a cover formed with an outflow port and configured to close the opened end of the case; an air cleaner disposed between the case and the cover and provided with a filter member dividing an interior of the air cleaner into a clean side positioned on the inflow port side and a dust side positioned on the outflow port side; and an outdoor air duct configured to introduce outdoor air into the air cleaner, wherein the air cleaner and the outdoor air duct are connected through a fitting duct, the fitting duct includes a wall section defining the dust side together with the case, and the wall section is assembled along the perpendicular direction with respect to the inflow port.

In the intake apparatus according to the present invention, it may be preferred that the inflow port is provided with a pair of side edges formed along an assembling direction of the fitting duct and with a lower end edge connecting lower end portions of the side edges, and a fitting member for fitting the paired side edges and the lower end edge is formed to the wall section.

In the intake apparatus according to the present invention, it may be preferred that the fitting duct is engaged with a first engaging projection formed to the case.

In the intake apparatus according to the present invention, it may be preferred that the first engaging projection includes a body portion projecting in a perpendicular direction from the case and an engaging portion projecting in a horizontal direction from an upper end of the body portion.

In the intake apparatus according to the present invention, it may be preferred that the fitting duct is engaged with a second engaging projection formed to the outdoor air duct.

It is further to be noted that the summary of the present invention described above does not list up all the features necessary for the present invention and combination of these features may constitute the present invention.

Effects of the Invention

In the intake apparatus of the present invention, the air cleaner and the outdoor air duct are connected together by means of fitting duct, which is provided with a wall section constituting the dust side together with the case, and the wall section is assembled along the perpendicular direction with respect to the inflow port. Therefore, after assembling the air cleaner and the outdoor air duct to a vehicle body, respectively, the fitting duct is inserted along the perpendicular direction to thereby connect the air cleaner and the outdoor air duct, thus easily mounting the intake apparatus to the vehicle body. Furthermore, since the dust side is defined by the interior of the case and the wall section of the fitting duct, the inflow port can be formed as a wide opening, and accordingly, when the filter member disposed inside the air cleaner is exchanged, even if the case is opened by disassembling the air cleaner, since the inflow port is formed as wide opening, the case does not interfere with other member or components mounted to an internal combustion engine, thus ensuring sufficient maintenance space therein.

Further, in the intake apparatus according to the present invention, the inflow port is provided with a pair of side edges formed along an assembling direction of the fitting duct and with a lower end edge connecting lower end portions of the side edges, and a fitting member for fitting the paired side edges and the lower end edge is formed to the wall section. Accordingly, it becomes possible to prevent water and dust from invading into the air cleaner by means of the fitting member.

Furthermore, in the intake apparatus according to the present invention, since the fitting duct is engaged with the first engaging projection formed to the case, the fitting duct can be easily attached or detached.

Still furthermore, in the intake apparatus according to the present invention, since the first engaging projection includes the body portion projecting in a perpendicular direction from the case and the engaging portion projecting in a horizontal direction from an upper end of the body portion, the engagement can be easily released by applying a force in the perpendicular direction, and hence, the fitting duct can be easily detached only along the perpendicular direction thereof.

Still furthermore, in the intake apparatus according to the present invention, since the fitting duct is engaged with the second engaging projection formed to the outdoor air duct, the fitting duct and the outdoor air duct can be further surely connected.

EMBODIMENT FOR CARRYING OUT THE INVENTION

Hereunder, a preferred embodiment for carrying out the present invention will be described with reference to the drawings. It is further to be noted that the following embodiment is not limited to the inventions according to respective claims, and that all the combinations of characteristic features explained in the embodiment is not always essential for the solution of the present invention.

Figure 1:
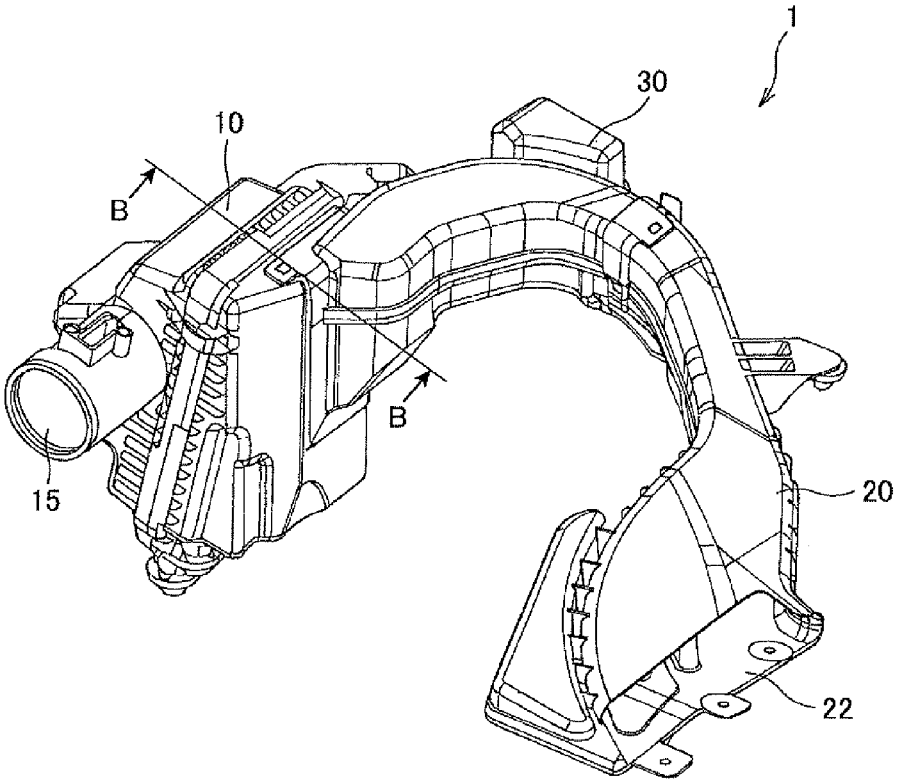
FIG. 1 is a perspective view for explaining an intake apparatus according to a present embodiment.
Figure 2:
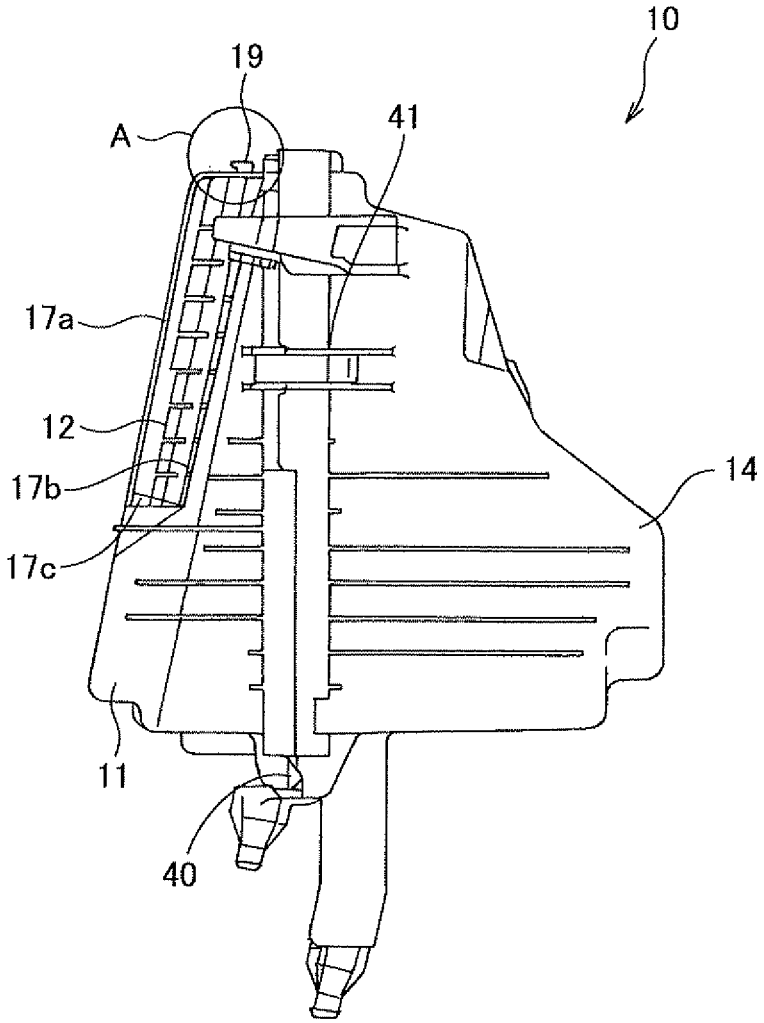
FIG. 2 is a front view for explaining an air cleanser of the intake apparatus of the present embodiment.
Figure 3:
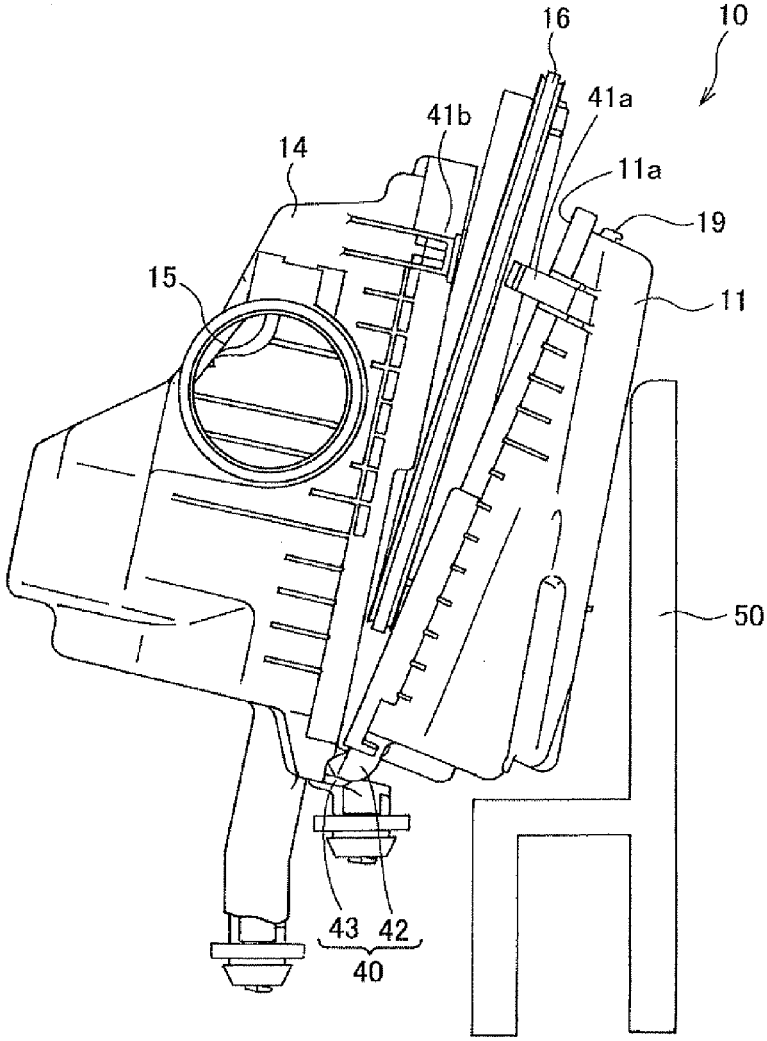
FIG. 3 is a developed view for explaining a disassembling method of the air cleaner.
Figure 4:
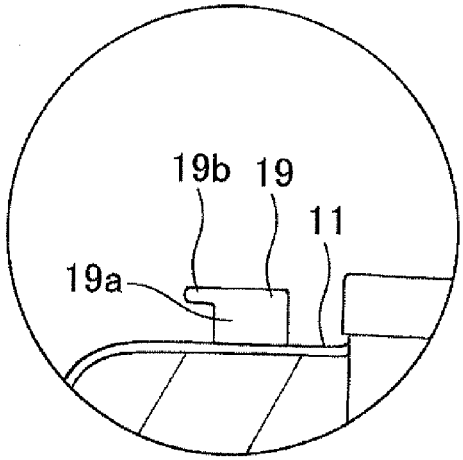
FIG. 4 is an enlarged view of a portion "A" in FIG. 2 for explaining structure of an engaging claw.
Figure 5:
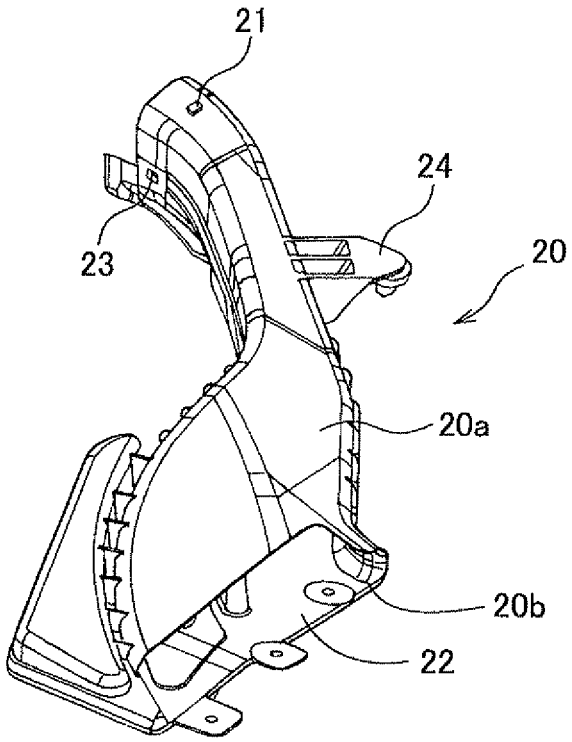
FIG. 5 is a perspective view for explaining an outdoor air duct of the intake apparatus according to the present embodiment.
Figure 6:
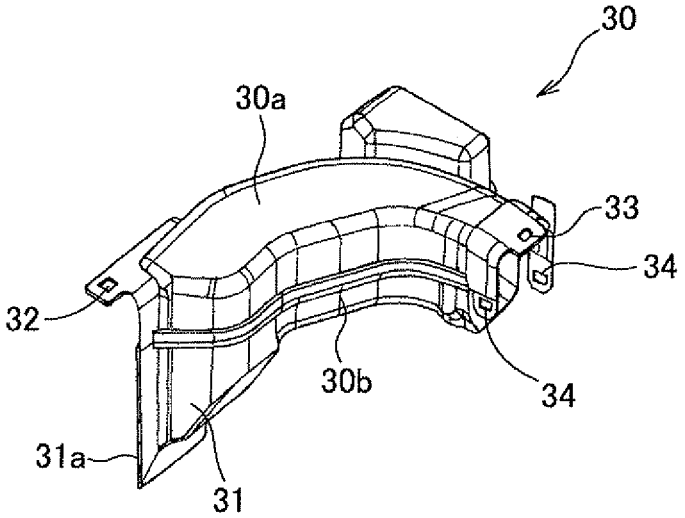
FIG. 6 is a perspective view for explaining a fitting duct of the intake apparatus according to the present embodiment.
Figure 7:
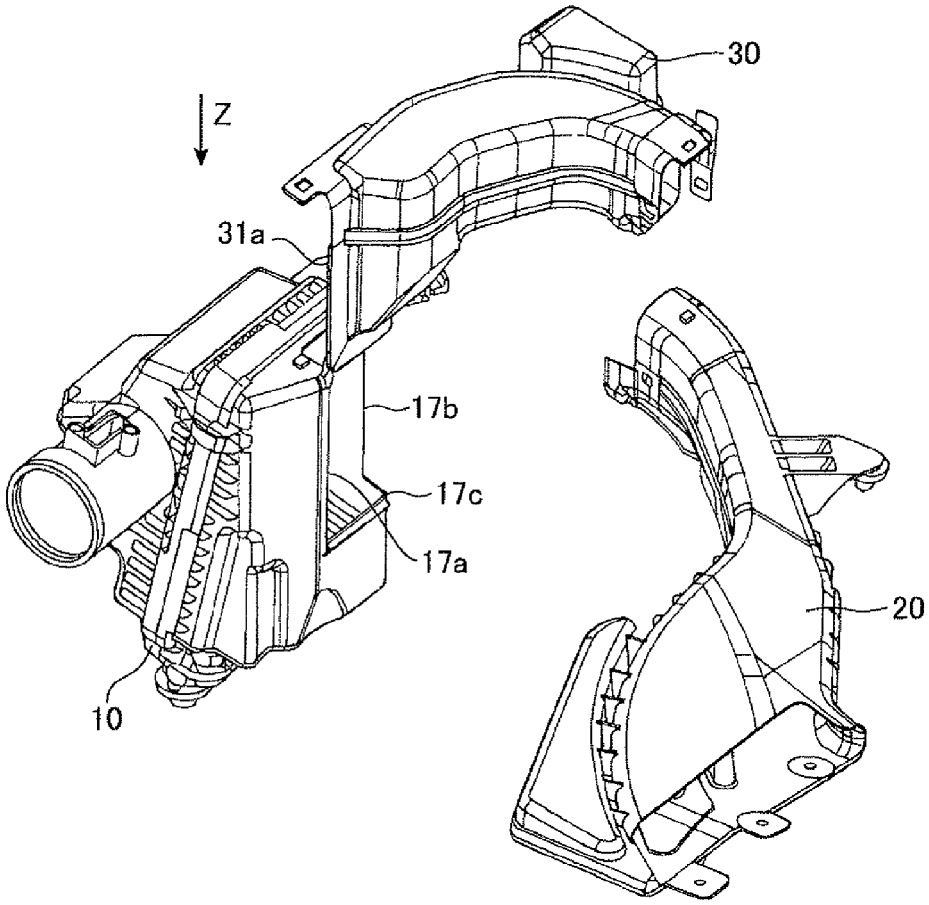
FIG. 7 is a perspective view for explaining an assembling method of the intake apparatus according to the present embodiment.
Figure 8:
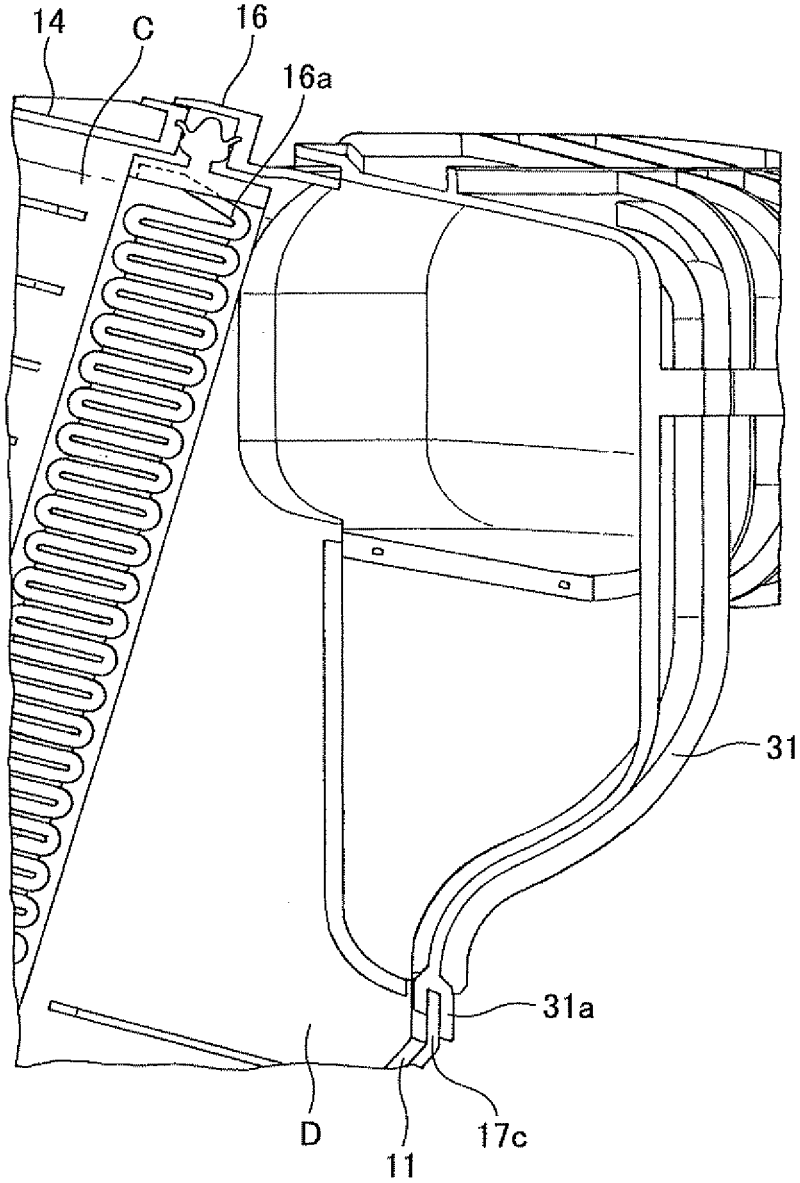
FIG. 8 is a sectional view taken along the line B-B in FIG. 1.

FIG. 1 is a front view for explaining an intake apparatus according to the present embodiment, FIG. 2 is a front view for explaining an air cleanser of the intake apparatus of the present embodiment, FIG. 3 is a developed view for explaining a disassembling method of the air cleaner, FIG. 4 is an enlarged view of a portion "A" in FIG. 2 for explaining structure of an engaging claw, FIG. 5 is a perspective view for explaining an outdoor air duct of the intake apparatus according to the present embodiment, FIG. 6 is a perspective view for explaining a fitting duct of the intake apparatus according to the present embodiment, FIG. 7 is a perspective view for explaining an assembling method of the intake apparatus according to the present embodiment, and FIG. 8 is a sectional view taken along the line B-B in FIG. 1. Further, it is to be noted that the vertical direction in FIG. 2 is defined as vertical direction on the drawings.

As shown in FIG. 1, the intake apparatus 1 according to the present embodiment incorporates a filter member for filtrating an outdoor air and is also provided with an air cleaner 10 for supplying a filtrated outdoor air into an internal combustion engine, an outdoor air duct 20 for introducing the outdoor air into the air cleaner 10, and a fitting duct 30 for connecting the air cleaner 10 and the outdoor air duct 20 together. The intake apparatus 1 thus constructed acts to introduce the outdoor air introduced through an outdoor air introducing port 22 formed to one end of the outdoor air duct 20 into the air cleaner 10 through the interiors of the outdoor air duct 20 and the coupling duct 30 and then to supply the outdoor air toward the internal combustion engine from an outflow port 15.

As shown in FIGS. 2 and 3, the air cleaner 10 includes a bottomed tubular case 11 provided with an opened end 11*a* and an inflow port 12, a cover 14 closing the opened end 11*a* of the case 11 and provided with an outflow port 15, and a filter member 16 disposed between the case 11 and the cover 14.

The inflow port 12 formed to the side surface of the case 11 is provided with a pair of side edge portions 17*a* and 17*b* formed along the perpendicular direction Z, which corresponds to the assembling direction of a fitting duct 30, described hereinlater, and a lower end edge portion 17*c* connecting lower ends of the side edge portions 17*a* and 17*b*, and the inflow port 12 is formed as a wide opening portion so that a wall portion 31 of the fitting duct 30 can be assembled. It is further to be noted that the inflow port 12 may be formed so as to have an opening area having a size approximately half of the side wall, for example, so as to ensure a possibly wide opening area with the rigidity of the case being ensured. Further, a pivot 42 having an axis extending in a perpendicular direction to the drawing surface is formed to the lower end of the case 11.

A first engaging projection 19 is formed to the upper end side of the side edge portions 17*a* and 17*b*. As shown in FIG. 4, the first engaging projection 19 includes a body portion 19*a* formed to the case 11 so as to project in the perpendicular direction from the outer wall surface of the case 11 and an engaging portion 19*b* formed so as to project in the horizontal direction from the upper end portion of the body portion 19*a*. The first engaging projection 19 acts to position the fitting duct 30 by means of the body portion 19*a* and couple the fitting duct 30 and the air cleaner 10 by the engaging portion 19*b* through the engagement with the fitting duct 30.

The cover 14 is formed, as described above, so as to close the opened end 11*a* of the case, and also formed with the outflow port 15 for guiding the outdoor air toward the internal combustion engine side. The cover 14 includes a lower end portion to which a support portion 43 capable of holding the pivot 42 of the case 11 to be rotatable in the axial direction.

As shown in FIGS. 3 and 8, the filter member 16 includes a filter element 16*a* filtrating the outdoor air introduced from the inflow port 12. The filter element 16*a* is manufactured by pleating machine working of a filter element such as non-woven cloth so as to intend to increase a filtrating area and suppress air-flow resistance. In addition, the filter member 16 divides the interior of the air cleaner 10 into a dust side D communicating with the inflow port 12 and a clean side C communicating with the outflow port 15.

The cover 14 is detachably assembled to the case 11 by means of clip 41*a* in a state in which the opened end 11*a* of the case is closed and the pivot 42 is engaged with the support portion 43. Further, as shown in FIG. 3, since the air cleaner 10 is provided with a hinge portion composed of the pivot 42 and the support portion 43, the filter member 16 disposed in the interior of the air cleaner 10 can be easily exchanged with new one without disassembling the case 11 and the cover 14 from each other. Accordingly, the filter member 16 can be easily exchanged in a state mounted to a vehicle body. The case 11 and the cover 14 may be formed of a thermoplastic synthetic resin such as polypropylene series resin or polyamide series resin.

Hereunder, the outdoor duct 20 will be explained with reference to FIG. 5.

The outdoor air duct 20 is a tubular member formed from a top (ceiling) portion 20*a* and a bottom portion 20*b* which are assembled with each other by a known welding method such as vibration welding. The outdoor air duct 20 has one end to which an outdoor air introducing port 22 is formed in a fan-like shape to effectively introduce the outdoor air. A second engaging projection 21 is formed on the top portion side of the other end of the outdoor air duct 20, and the second engaging projection has approximately the same shape of the body portion 19*a* of the first engaging projection 19 from which the engaging portion 19*b* is removed. In addition, on the side surface of the other end of the outdoor duct 20, an engaging means 23 is formed so as to project from an outer wall section of the outdoor air duct 20.

Next, the fitting duct 30 will be explained with reference to FIG. 6.

The fitting duct 30 is a tubular member including a first section member 30*a* and a second section member 30*b* which are assembled by a known welding method such as vibration welding. The fitting duct 30 has one end portion to be assembled with the air cleaner 10, and a first engagement portion 32 to be engaged with the first engaging projection 19 formed to the air cleaner 10 is formed to this one end portion. The fitting duct 30 has another end portion to be assembled with the outdoor air duct 20, and a second engagement portion 33 to be engaged with the second engaging projection 21 formed to this another end portion. In addition, an engagement means 34 to be engaged with the engaging means 23 is also formed to the another end portion with which the outdoor air duct 20 is assembled together with the second engagement portion 33 to be engaged. The engagement means 34 to be engaged extends along a perpendicular direction corresponding to the mounting direction of the fitting duct 30.

The first and second engagement portions 32 and 33 to be engaged are formed with holes into which body portions 19*a* of the first and second engaging projections 19 and 21 are fitted, and the first and second engagement portions 32 and 33 to be engaged are fitted between the engaging portion 19*b* and the outer wall surface of the air cleaner 10 and between the engaging portion 19*b* and the outer wall surface of the outdoor air duct 20 to thereby realize the coupling configuration between the air cleaner 10 and the fitting duct 30 and between the air cleaner 10 and the outdoor air duct 20, respectively.

Furthermore, a wall section 31 extending downward is formed to the end portion of the fitting duct 30 at which the fitting duct 30 is assembled with the air cleaner 10. As shown in FIG. 8, the wall section 31 is mounted to the inflow port 12 of the case 11 to thereby constitute the dust side D. Furthermore, the engaging means 31*a* having U-shaped section is formed to an end edge at which side edges 17*a*, 17*b* and a lower end edge 17*c* of the wall section 31 are assembled together. Further, the outdoor air duct 20 and the fitting duct 30 may be formed of thermoplastic synthetic resin material such as polypropylene series resin, polyamide series resin or like.

As described above, since the intake apparatus 1 according to the present embodiment is composed of the air cleaner 10, the outdoor air duct 20 and the fitting duct 30, the intake apparatus 1 can be assembled by assembling the fitting duct 30 after the mounting of the air cleaner 10 and the outdoor air duct 20 to the vehicle body, as shown in FIG. 7, thus improving the assembling performance of the intake apparatus 1 to the vehicle body. In addition, a labyrinth structure is realized to the edge portion of the inflow port 12 by the fitting means 31*a*, so that the intrusion of dust and dirt from the outside can be prevented Furthermore, the fitting duct 30 can be mounted from the perpendicular direction of the vehicle body by fitting together the fitting means along the side edges 17*a* and 17*b*, and can be engaged by being engaged with the first and second engaging projections 19 and 21. Accordingly, screw fastening working or band winding working is not needed, thereby improving the working efficiency for the assembling of the intake apparatus 1. Further, according to the present embodiment, the disassembling of the fitting duct 30 is performed by releasing the engagement between the engaging means 23 and the engagement means 34 to be engaged and between the first and second engaging projections 19 and 21 and the first and second engagement portions 32 and 33 to be engaged, respectively, so that the disassembling working can be made only by performing the releasing working in the perpendicular direction even in the assembled state of the intake apparatus 1 to the vehicle body.

Still furthermore, since the fitting duct 30 of the intake apparatus 1 according to the present embodiment can be removed with the intake apparatus 1 being mounted to the vehicle body, the position at which the fitting duct 30 is assembled can be utilized as a space for maintenance by removing the fitting duct 30, and hence, sufficient maintenance space can be ensured even in a narrow space.

Still furthermore, since the fitting duct 30 is provided with the wall section 31 constituting the dust side D, the inflow port 12 having large opening can be formed to the case 11 by removing the fitting duct 30. As mentioned above, according to the intake apparatus 1 of the present embodiment, since the inflow port 12 is formed to have a large opening, when the case 11 is rotated with the pivot axis 42 being the rotating center so as to perform the exchanging working of the filter member 16 as shown in FIG. 3, the interference of the case 11 with various devices or components 50 for carrying out the operation of the internal combustion engine of a vehicle can be prevented, thereby widely opening the case 11 and ensuring the further sufficient maintenance space.

As described hereinabove, with the intake apparatus according to the present embodiment described above, although the description is made such that the outdoor air duct is formed in a manner such that the outdoor air introducing port has a fan-like shape, the shape of the outdoor air introducing port is not limited to such shape, and it may be formed so as to have a straight shape, for example.

Furthermore, according to the intake apparatus of the present embodiment, although the description is made such that the case 11 and the cover 14 are assembled by means of clip, the assembling method of the case 11 and the cover 14 is not limited to such manner, and the assembling may be made by bolt-nut fastening means, for example. It is thus apparent that such alternation and improved modification may be included in the technical scope of the present invention as is apparent from the scope of the appended claims.

REFERENCE NUMERAL

1 - - - intake apparatus, 10 - - - air cleaner, 11 - - - case, 12 - - - inflow port, 14 - - - cover, 15 - - - outflow port, 16 - - - filter member, 17*a*, 17*b*, - - - side edge, 17*c* - - - lower end edge, 19 - - - first engaging projection, 20 - - - outdoor air duct, 21 - - - second engaging projection, 22 - - - outdoor air introducing port, 23 - - - engaging means, 30 - - - fitting duct, 31 - - - wall section, 31*a* - - - fitting means, 40 - - - hinge portion, 42 - - - pivot, 43 - - - support portion, Z - - - perpendicular direction, C - - - clean side, D - - - dust side.

The invention claimed is:

1. An intake apparatus comprising:

a bottomed tubular case having an opened end and formed with an inflow port;

a cover formed with an outflow port and configured to close the opened end of the case;

an air cleaner disposed between the case and the cover and provided with a filter member dividing an interior of the air cleaner into a clean side positioned on the outflow port side and a dust side positioned on the inflow port side; and an outdoor air duct configured to introduce outdoor air into the air cleaner, wherein the air cleaner and the outdoor air duct are connected through a fitting duct, the fitting duct includes a wall section defining the dust side together with the case, and the wall section is assembled along the perpendicular direction with respect to the inflow port, wherein the fitting duct is configured to be inserted along the perpendicular direction to thereby connect the air cleaner and the outdoor air duct, after assembling the air cleaner and the outdoor air duct to a vehicle, and wherein the inflow port is provided with a pair of side edges formed along an assembling direction of the fitting duct and with a lower end edge connecting lower end portions of the side edges, and a fitting member for fitting the paired side edges and the lower end edge is formed to the wall section.

2. The intake apparatus according to claim 1, wherein the fitting duct is engaged with a first engaging projection formed to the case.

3. The intake apparatus according to claim 2, wherein the first engaging projection includes a body portion projecting in a perpendicular direction from the case and an engaging portion projecting in a horizontal direction from an upper end of the body portion.

4. The intake apparatus according to claim 1, wherein the fitting duct is engaged with a second engaging projection formed to the outdoor air duct.

* * * * *